US010029848B2

(12) United States Patent
Yaremenko et al.

(10) Patent No.: US 10,029,848 B2
(45) Date of Patent: Jul. 24, 2018

(54) FLEXIBLE LIQUID TRANSPORT TANK WITH SURGE DAMPENING BAFFLES

(76) Inventors: Victor Yaremenko, Port Coquitlam (CA); Richard Lumsden, Surrey (CA); George Bartz, Delta (CA); Paul Reichard, Delta (CA)

( * ) Notice: Subject to any disclaimer, the term of this patent is extended or adjusted under 35 U.S.C. 154(b) by 2002 days.

(21) Appl. No.: 13/101,916

(22) Filed: May 5, 2011

(65) Prior Publication Data

US 2011/0272413 A1 Nov. 10, 2011

Related U.S. Application Data

(60) Provisional application No. 61/331,712, filed on May 5, 2010, provisional application No. 61/449,197, filed on Mar. 4, 2011.

(51) Int. Cl.

| | |
|---|---|
| ***B65D 6/00*** | (2006.01) |
| ***B65D 8/00*** | (2006.01) |
| ***B65D 8/14*** | (2006.01) |
| ***B65D 25/00*** | (2006.01) |
| ***B65D 1/24*** | (2006.01) |
| ***B64D 37/06*** | (2006.01) |
| ***B64D 37/08*** | (2006.01) |
| ***B65D 1/42*** | (2006.01) |
| ***B65D 88/08*** | (2006.01) |
| ***B65D 33/02*** | (2006.01) |
| ***B65D 90/52*** | (2006.01) |
| ***B65D 88/16*** | (2006.01) |
| ***B65D 90/00*** | (2006.01) |

(52) U.S. Cl.

CPC ..... *B65D 88/1606* (2013.01); *B65D 90/004* (2013.01); *B65D 90/52* (2013.01)

(58) Field of Classification Search

CPC ..... B64D 37/06; B64D 37/08; B65D 1/42; B65D 8/08; B65D 25/02; B65D 33/02; B65D 88/22; B65D 88/16; B65D 90/52

USPC ... 220/4.12, 6, 9.4, 530, 651, 652, 653, 654; 383/104, 119

See application file for complete search history.

(56) References Cited

U.S. PATENT DOCUMENTS

| | | | | | |
|---|---|---|---|---|---|
| 2,024,908 | A * | 12/1935 | Blum | ..... | 383/105 |
| 2,355,084 | A * | 8/1944 | Kurrle | ..... | 220/564 |
| 4,399,850 | A * | 8/1983 | Schiemann | ..... | 220/653 |
| 5,368,395 | A * | 11/1994 | Crimmins | ..... | 383/107 |
| 5,403,095 | A * | 4/1995 | Melk | ..... | 383/110 |
| 6,565,256 | B2 * | 5/2003 | Derby et al. | ..... | 383/119 |

* cited by examiner

*Primary Examiner* — Andrew T Kirsch

(57) ABSTRACT

Flexible tanks for transporting liquids comprising a flexible bladder to contain liquid, several transverse surge dampening baffles inside the bladder, each baffle comprising several flexible panels, each having a base connected to the inside of the bladder and aligned along a plane transverse to the bladder and an unsupported terminal end opposite the base and adapted to converge with the unsupported portions of adjacent panels in a manner that defines a barrier to fluid flow across the transverse baffle when the bladder is filled; and a connector for interconnecting the terminal ends of the panels. There may be provided a flexible outer bladder of an abrasion resistant material that is adapted to removably receive the inner bladder. There may be provided longitudinal baffles situated between adjacent transverse baffles that define longitudinal compartments with restricted fluid flow there between for dampening lateral fluid surges.

10 Claims, 8 Drawing Sheets

FLEXIBLE LIQUID TRANSPORT TANK WITH SURGE DAMPENING BAFFLES

BACKGROUND OF THE INVENTION

1. Field of the Invention

The present invention generally relates to flexible tanks for transporting liquids, and more particularly to flexible transportation tanks of the type comprised of a fluid resistant fabric material which, when filled, may be transported by air carrier to a desired location, and when emptied may be rolled and/or folded into a compact size for return transport and refilling.

2. Description of Related Art

Flexible containers are used for the handling, storage and transportation of large volumes of liquids, such as water or fuel, to remote sites. These containers are commonly referred to as bladder or pillow tanks, and they are typically rectangular so that they can be efficiently loaded onto vehicles for transportation. Examples of some prior art flexible liquid containers are found in U.S. Pat. No. 4,573,508 to Knaus and U.S. Pat. No. 5,499,743 to Blumenkron. Flexible liquid containers, such as exemplified in Knaus and Blumenkron, are typically made of a flexible fiber reinforced elastomeric material and have inlets or nozzles for filling and draining purposes. A principal advantage to such flexible liquid containers is that they are relatively lightweight and compact when not filled with a liquid since they do not have a frame or rigid supports. However, while they provide an efficient means of transporting large volumes of liquid, these kinds of flexible tanks have an inherent tendency to allow the free flow of liquid within them which can lead to liquid surges as a result of the acceleration and deceleration of the liquid. It has long been recognized that free flowing liquids can be dangerous to the balance and control of aircraft or vehicles.

As a solution to the above summarized problem, U.S. Pat. No. 3,288,186 to Headrick discloses a surge attenuating baffle and pillow tank combination. The baffle comprises a plurality of flexible, elongated, tapered pockets having opposite open ends. The pockets are disposed with their respective elongate extents substantially parallel with the direction of the surge of liquid in an elongate pillow tank. A base strip is directly secured circumferentially to the interior surface of the pillow tank transversely to the length of the tank. A baffle strip is then secured by grommets and laces to the base strip along regularly spaced alternatively converging and diverging lines on the base strip so that the pockets in their fully extended state have substantially semicircular cross sections. The disadvantage of this design is that the pockets or convolutions that attenuate the liquid surges in the tank are usually in a collapsed state when the liquid is at rest in the tank. Therefore, at least some initial movement of the surging liquid is required before the baffles extend and become operative in attenuating the surge of the liquid in the tank. As a solution to this problem, Headrick devised an improvement to his system of baffles, as described in U.S. Pat. No. 4,427,045, the improvement being that the baffles are made of a material that is flexible to allow collapse of the tank upon withdrawal of the liquid therefrom, but that is substantially shape retaining so that the hollow, truncated and tapered convolutions to be present in the tank when the liquid in the tank is at rest.

While the Headrick baffle systems may operate to attenuate some fluid surges in a flexible fluid tanks, the baffles introduce significant complexity and cost to the manufacture of the flexible tanks in which they are employed, and they also significantly increase the weight and bulk of the flexible tank when empty and thereby affect its collapsibility. Furthermore, while the Headrick flexible tank and baffle system may operate to attenuate some fluid surges in a flexible fluid tank in the longitudinal direction to the tank, they do very little to attenuate fluid surges in lateral directions. Dampening later fluid surges may be important in certain aircraft applications in which the tank is likely to encounter lateral acceleration in addition to longitudinal acceleration, such as for example in helicopter applications where the aircraft creates side-to-side movement (lateral acceleration) for the tank contents and front to back movement (longitudinal acceleration).

Accordingly there is a need for a flexible tank for transporting liquids having internal structures by which the significant wave or liquid current forces may be dampened, yet which do not add significant weight or bulk to the tank to significantly hinder the collapsibility of the tank, and which do not significant increase the time, materials and costs of manufacture of the flexible tanks. In some aspects, there is a need for a flexible tank for liquids having internal structures by which the significant wave or liquid current forces may be dampened in both longitudinal and lateral directions. The devices of the present invention are provided to fulfill one or more of these needs as will be understood from the following description.

SUMMARY OF THE INVENTION

In order to address some of the shortcomings in the prior art, some aspects of the present invention provide a flexible tank for transporting liquids on or in a vehicle comprising: a flexible and collapsible bladder adapted to contain liquid therein and having ports for filling and emptying the bladder, the bladder defining a length and an interior perimeter; a plurality of vertical flexible internal baffles inside the bladder for dampening surges of liquid wherein each internal baffle is aligned in a plane transverse to the length of the bladder and comprises a plurality of flexible panels, wherein each panel includes a base portion connected to the interior surface of the bladder and an unsupported portion with a terminal end opposite the base portion, wherein each panel is shaped so that its terminal end converges with the terminal end of one or more adjacent panels; and a link mechanism cooperating with the terminal ends of the panels of each internal baffle to interconnect the terminal ends to provide a barrier to fluid flow across the internal baffle when the bladder is filled with fluid.

In some embodiments, the panels of each internal baffle may be aligned along the plane transverse to the length of the bladder when the terminal ends are interconnected by the link mechanism.

In some embodiments, the link mechanism may comprise a loop portion provided in the terminal end of each panel and a cord that weaves through the loop portions to interconnect the terminal ends of the panels.

In some embodiments, each transverse panel may be shaped in a manner that enables the internal baffle to cover most of the internal cross sectional area defined by the bladder with liquid therein such that adjacent internal transverse baffles define a substantially compartmentalized space in between said adjacent transverse baffles.

In some embodiments, there may be further provided a liquid impermeable flexible outer bladder of an abrasion resistant material that is adapted to removably receive said flexible and collapsible bladder adapted to contain liquid therein, wherein the outer bladder includes an access port through which said flexible and collapsible bladder may be placed in and removed from the outer bladder, and a liquid impermeable zipper cooperating with the access port to provide a liquid tight seal of the access port. The outer bladder may further include adjustable securing straps or webbing attached to the outer bladder and adapted to cooperate with securing points on the vehicle for securing the apparatus to the vehicle.

In some embodiments, there may be further provided a longitudinal baffle situated between two adjacent transverse baffles, the longitudinal baffle comprising a plurality of flexible planar longitudinal panels, each longitudinal panel having a second base portion connected to the inside surface of the bladder along a line parallel to the longitudinal axis of the bladder and spaced from the second base portions of adjacent longitudinal panels around the interior perimeter of the bladder, each longitudinal panel having a second unsupported portion with a second terminal edge opposite the second base portion and being adapted to converge with the second terminal edges of adjacent longitudinal panels along a line parallel to the longitudinal axis of the bladder in a manner that defines longitudinal compartments between adjacent transverse baffles with restricted fluid flow between said longitudinal compartments when the bladder is filled with fluid; and a second link mechanism that cooperates with the second terminal edges of adjacent longitudinal panels to interconnect the second terminal edges.

The present invention provides a flexible fuel (or other liquid) transport tank that enables cargo aircraft, both civilian and military, to support remote site fuel cache operations. Each tank may be customized and fitted to specific fixed wing or rotary wing aircraft to maximize the lifting capabilities of the air craft and to ensure the correct centre of gravity and liquid surge dampening system is applied.

Operators generally want the ability to transport bulk fuel to remote camps that are only serviceable by small air craft. The alternatives to a flexible transport tank is a plurality of metal drum fuel tanks or hard tanks flown in aircraft that are typically too large to land in within the confined spaced of the remote site.

Military operators want the ability to support remote fuel caches with bulk fuel transport tanks for emergency applications, northern operations and re-supply of fire bases that are cut off because ground transport is too risky due to enemy activity or improvised explosive devices (IED), or remote jungle or arctic bases where water or ground transportation is unavailable.

The flexible liquid transport tanks of the present invention effectively convert any aircraft into a flying tanker, enabling bulk fuel to be delivered to remote sites. When a flexible liquid transport tank is empty, it can be rolled up and stored, thereby releasing the space in the aircraft for other cargo or passengers.

One of the benefits provided by the present invention is that it eliminates wasted flights where only empty fuel drums or hard tanks are being removed from remote sites; the return flights can be used to carry other payloads. This not only saves money, but is a more environmentally sound practice since many empty conventional fuel drums are usually simply abandoned at the remote sites. The present invention also enables virtually any aircraft to be quickly converted into or from a bulk fuel tanker, thereby allowing for dual use operations. The present invention further reduces contamination and fuel loss from minor spills that are often associated with fuel drums, and it reduces the overall environmental footprint of a remote site fueling operation.

The flexible liquid transport tank of the present invention is designed to minimize liquid dynamics and any effects to the centre of gravity of the aircraft. The tank has a new and unique fabric and cable baffling system that limits the liquid dynamic of the fuel during flight. This new cable baffling system enables the manufacturer to custom size each tank to specific aircraft.

BRIEF DESCRIPTION OF THE DRAWINGS

For a better understanding of the present invention and to show more clearly how it may be carried into effect, reference is made by way of example to the accompanying drawings in which.

DETAILED DESCRIPTION OF THE INVENTION

Figure 1:
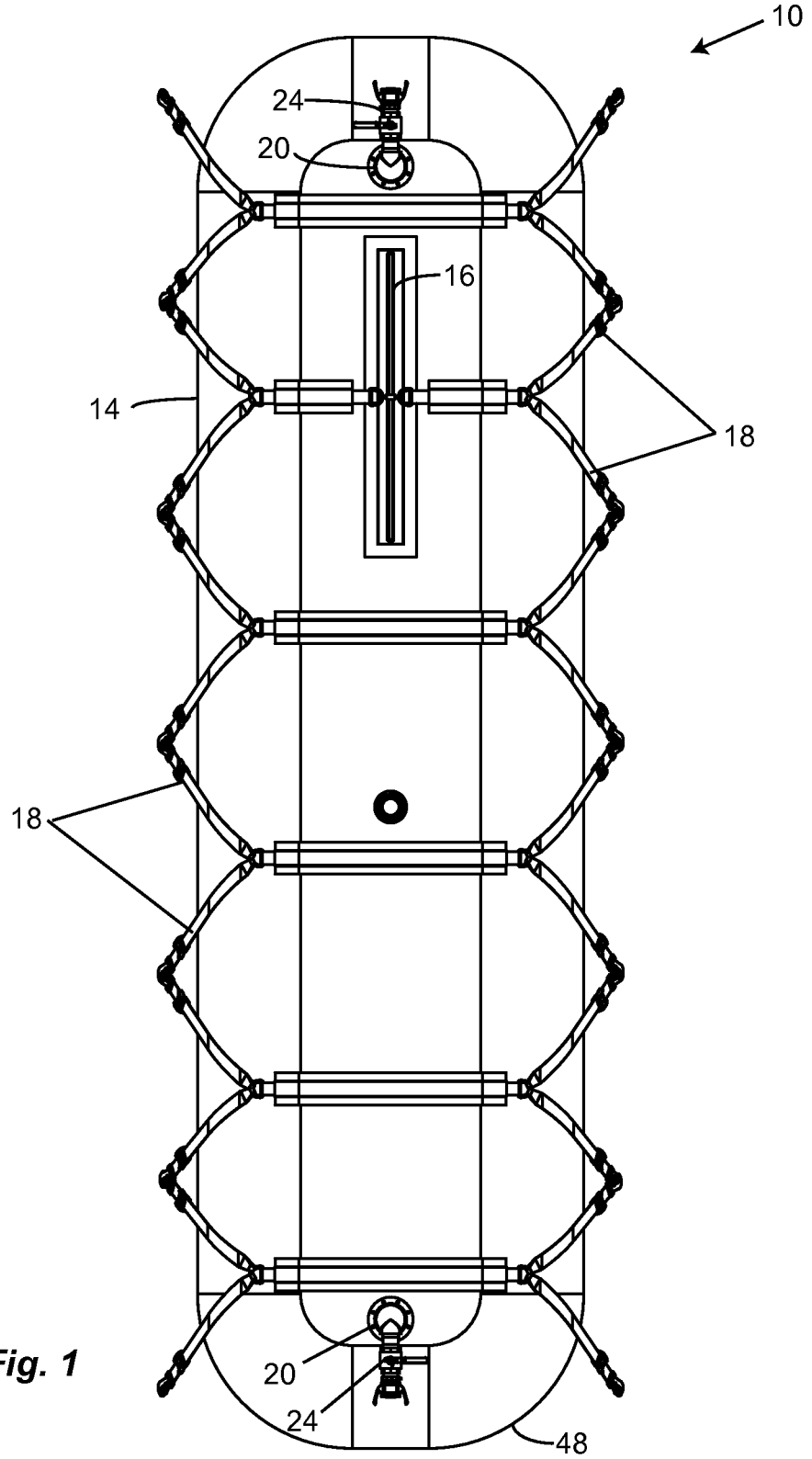
FIG. 1 is a top plan view of a flexible liquid transport tank of the present invention showing the outer tank.
Figure 2:
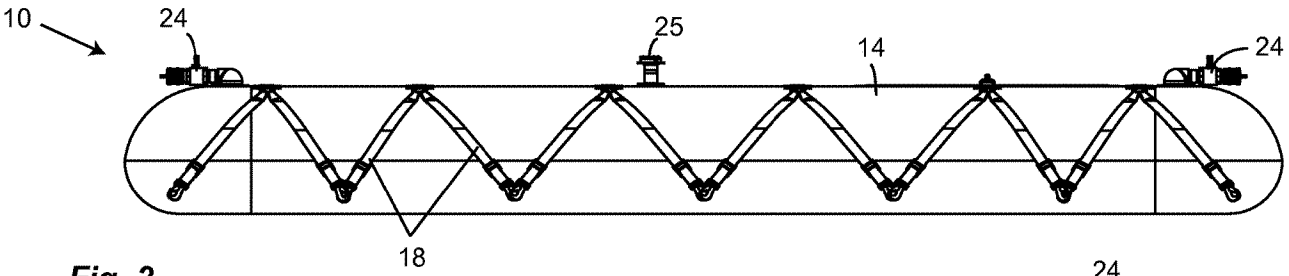
FIG. 2 is a side elevation view of the outer tank of the flexible liquid transport tank in FIG. 1.
Figure 3:
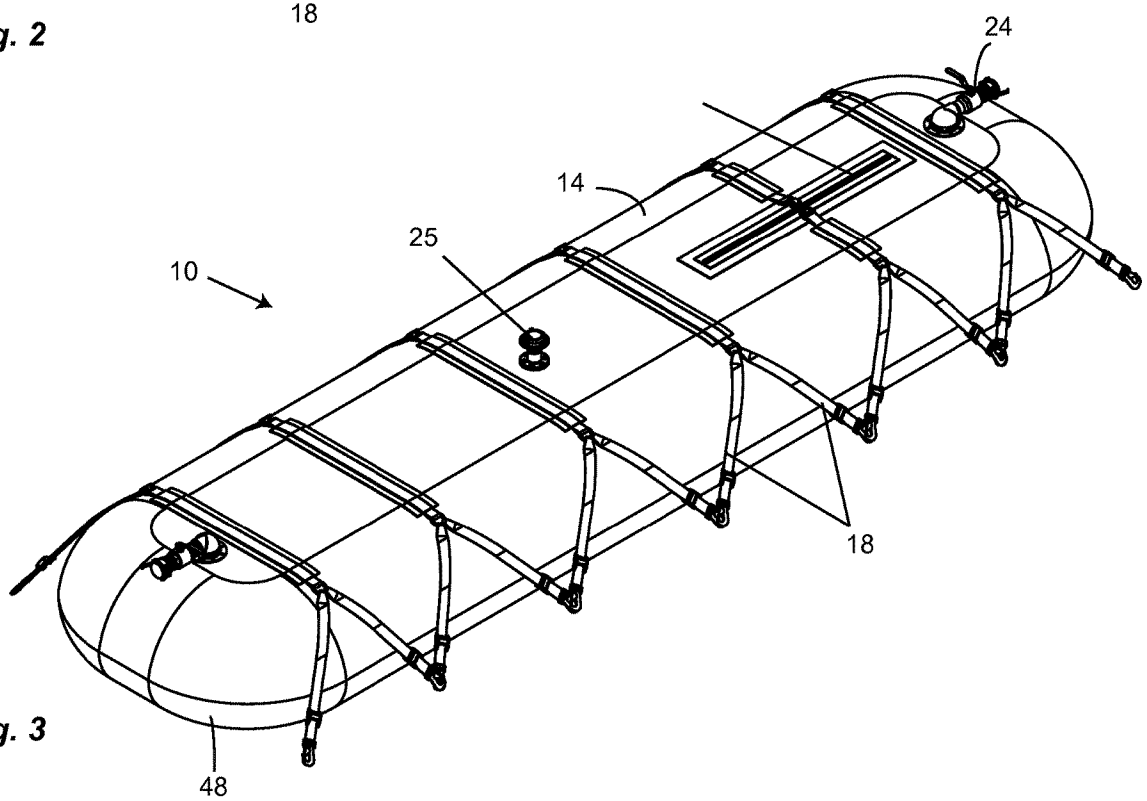
FIG. 3 is a perspective view from the top of the outer tank of the flexible liquid transport tank in FIG. 1.
Figure 4:
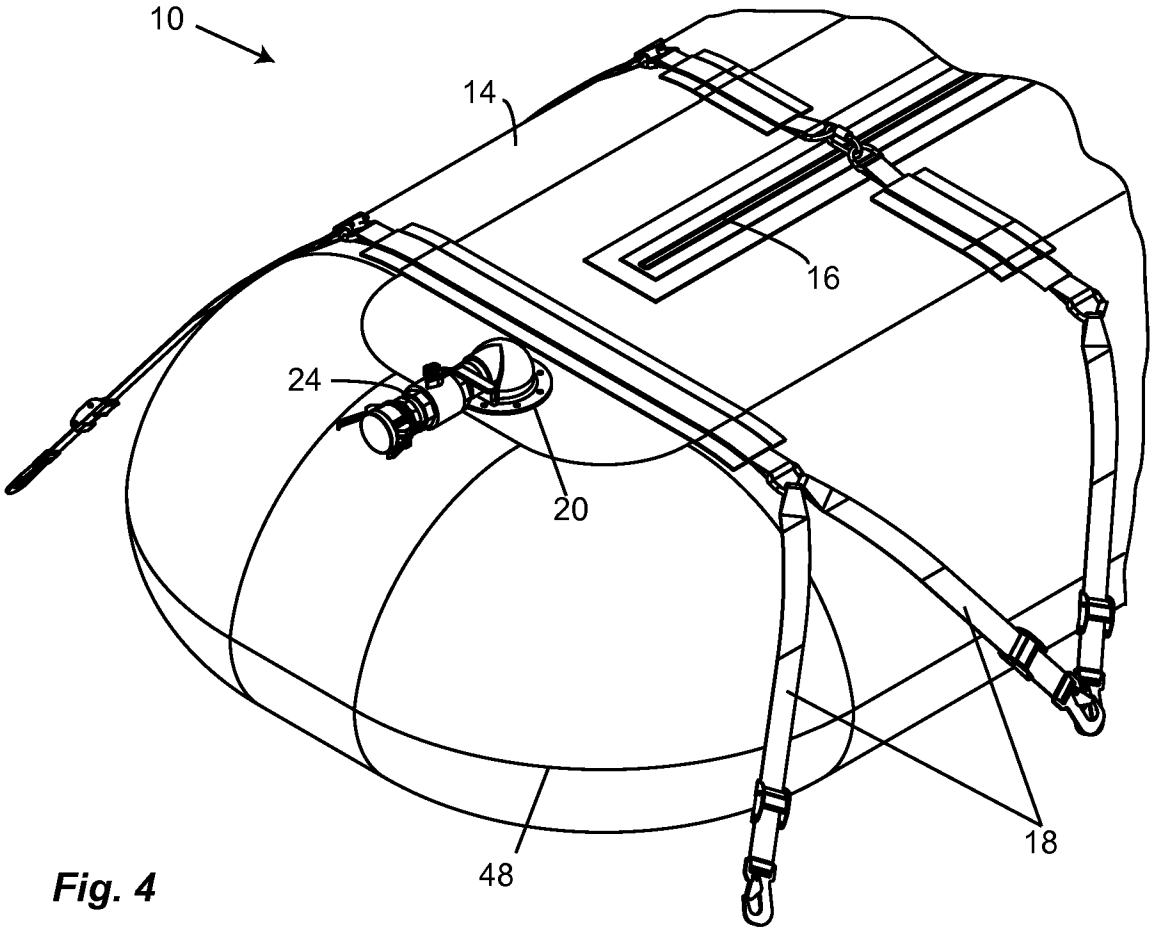
FIG. 4 is a close-up perspective view from the top of an end of the outer tank of the flexible liquid transport tank in FIG. 1.
Figure 5:
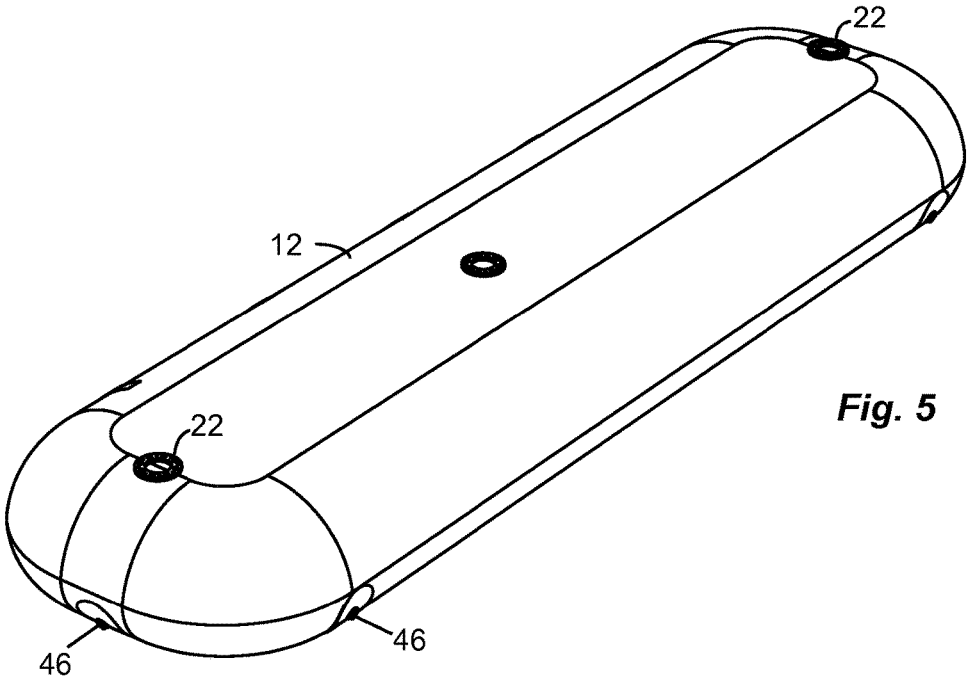
FIG. 5 is a perspective view from the top of the inner tank of the flexible liquid transport tank in FIG. 1.
Figure 6:
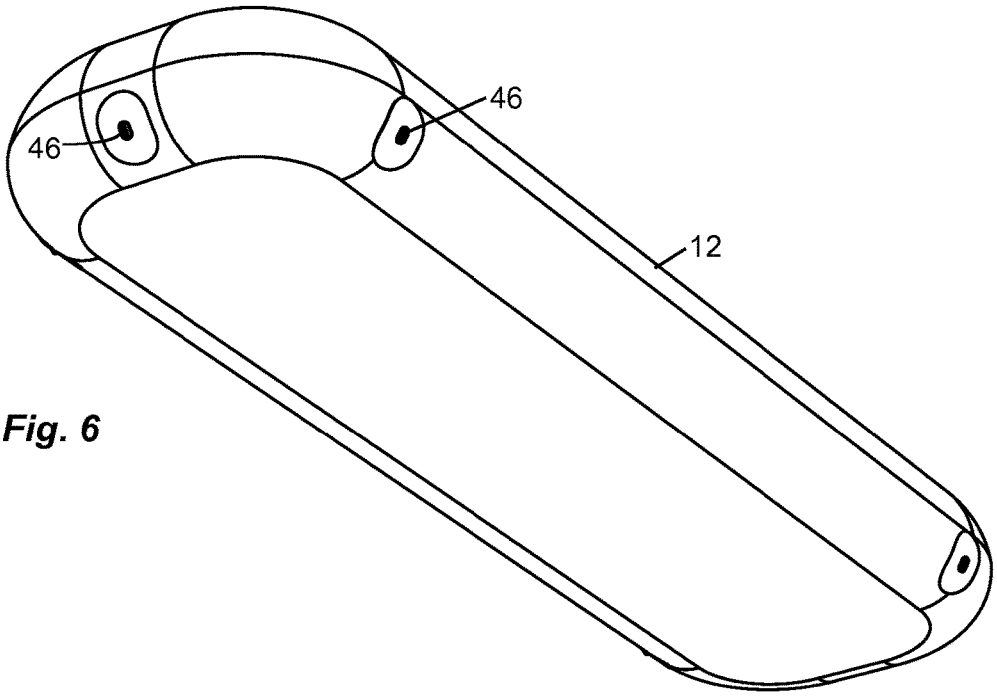
FIG. 6 is a perspective view from the bottom of the inner tank of the flexible liquid transport tank in FIG. 1.
Figure 7:
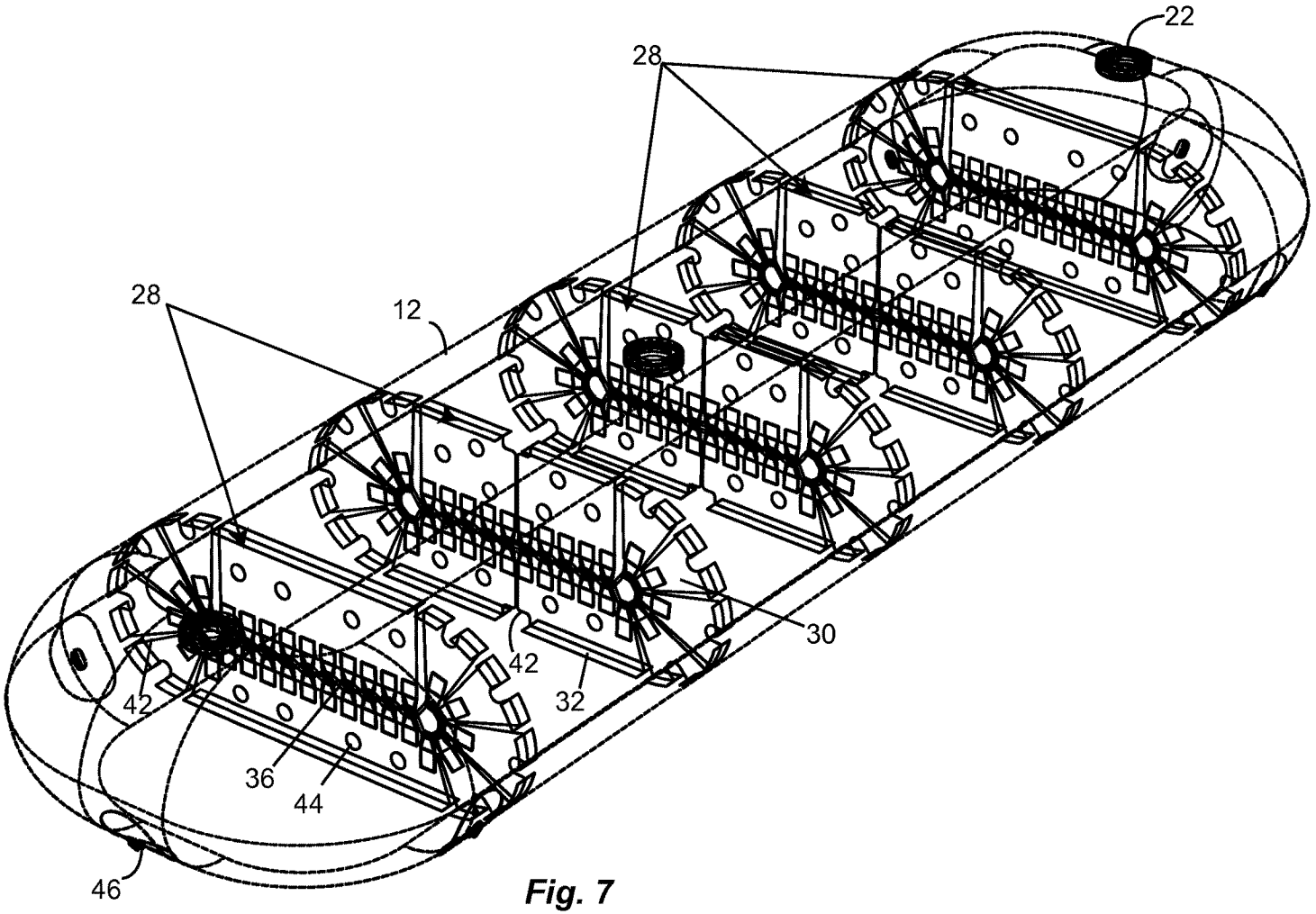
FIG. 7 is a perspective view from the top of the inner tank of the flexible liquid transport tank in FIG. 1, with the walls of the inner tank shown translucent to reveal the structure of the baffles within the inner tank.
Figure 8:
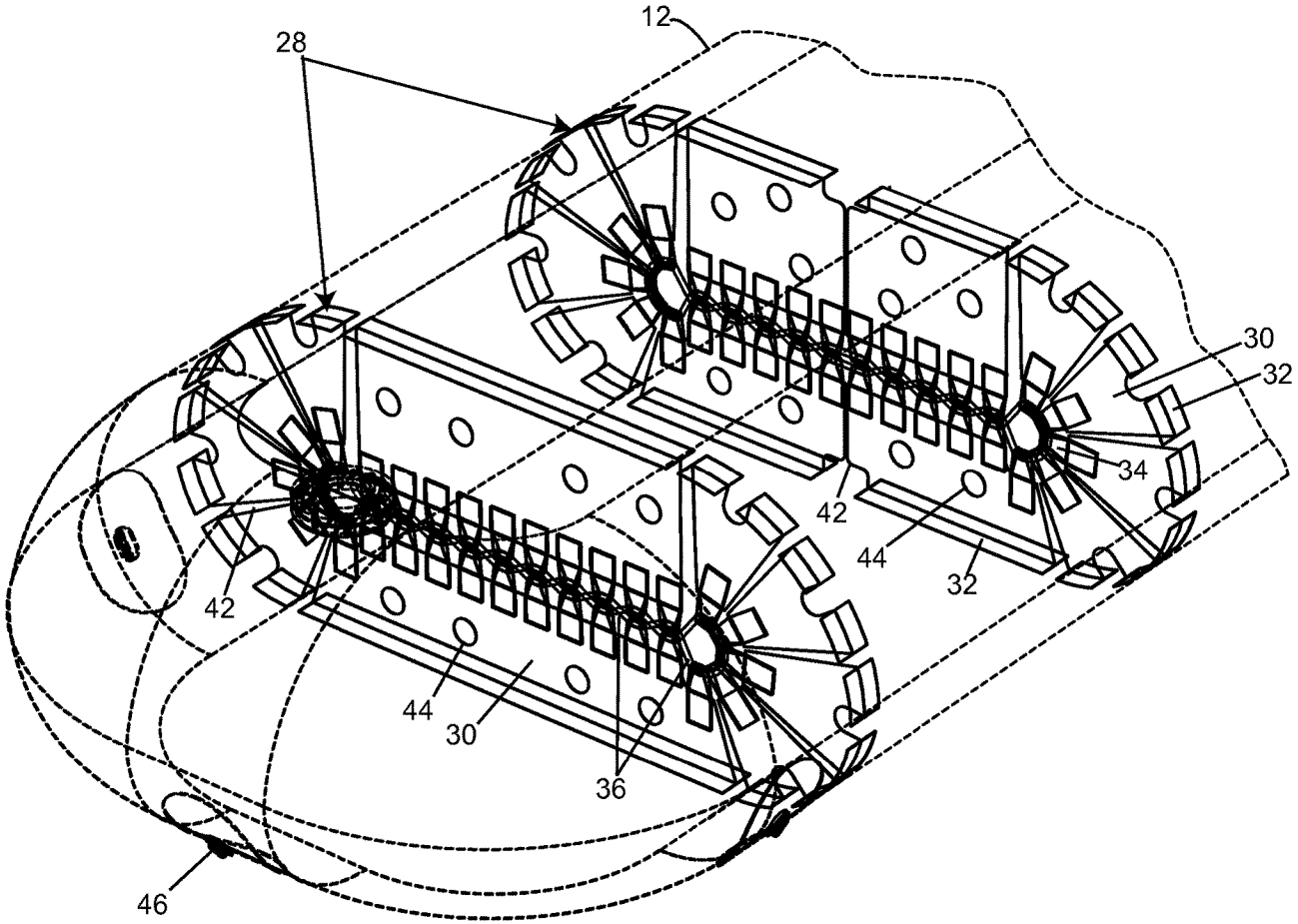
FIG. 8 is a close-up perspective view from the top of an end of the inner tank of the flexible liquid transport tank in FIG. 1, with the walls of the inner tank shown translucent to reveal the structure of the baffles within the inner tank.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring to FIGS. 1-8, an embodiment of a flexible liquid transport tank in accordance with the present invention is shown generally by reference number 10. The flexible liquid transport tank illustrated is a double layered or "walled" design, comprising of an inner tank 12 that is removably received within an outer tank 14. The inner tank 12 is a flexible and collapsible bladder adapted to contain liquid, hence it is designed to be in constant contact with the liquid, which may be a hydrocarbon fuel. In embodiments intended for fuel applications, the inner tank 14 is made of material that is compatible for use with hydrocarbon fuels. Such material is well known in the art of bladder tanks designed for hydrocarbon fuel storage. Examples include a heavy duty urethane coated fabric. Test strips of the same material as the inner tank may be provided that may be attached to the tank; the test strips may be reviewed periodically (perhaps annually) to assess material deterioration due to chemical interaction, abrasion or aging.

The outer tank 14 provides a flexible outer bladder that is adapted to removably receive the inner tank 12. The outer tank 14 is preferably highly abrasion and puncture resistant and, in embodiments intended for fuel applications, it is also chemically resistant to hydrocarbon fuel. A suitable material for the outer tank is an abrasion resistant urethane coated fabric, which is known and used in inflatable booms for the containment of oil spills. A liquid tight zipper 16 is provided on an access port on the outer tank 14 to enable the inner tank to be removed for inspection or replacement while providing a liquid tight seal of the access port. The location and/or the configuration of the zipper 16 may vary from one design of tank to another. The outer tank also may include a customizable webbing system 18 built in to enable the tank to be secured to the cargo floor of an aircraft or vehicle.

To provide for safe transport by aircraft, each flexible liquid transport tank may be designed for use with a particular aircraft or model of aircraft. As well, the tank should preferably transported either completely full to minimize fluid dynamics, or empty. In embodiments intended to carry hydrocarbon fuels, the inner tank should be fuel compatible and the fabric in contact with the fuel should meet U.S. Military Specification Mil-Spec 52983, the parameters of which are incorporated herein by reference. The tank should have a fuel resistant outer layer that is resistant to heavy abrasion. The built in adjustable webbing/strapping system 18 that provide the tie down locations on the tank may be specific to the particular aircraft or model of aircraft for which a tank is designed.

Each tank has one or two dedicated fill and drain ports 20,22 with valves 24 on the outer tank 14 to facilitate filling and discharging of liquid, and in embodiments for fuel transport, a flame arrestor vent 25 the location of which may depend on the type of aircraft for which the tank is designed to enable proper function during takeoffs and landings.

The inner tank 12 is provided with a plurality of internal transverse baffles 28, each baffle being disposed in a plane that is substantially transverse to the principal direction of surge action of the liquid (fuel) in the tank (i.e. substantially transverse to the length of the inner tank). Each baffle 28 is comprised of a plurality of flexible planar transverse panels such as flap portions 30 having a base portion 32 that is attached (welded) to the inside wall of the inner tank and aligned along a line circumscribed by a plane transverse to a length of the inner tank 12, hence in line with the plane of the baffle 28. Each flap portion 30 has an unsupported portion or free end that includes a terminal end with a loop 34, and the free ends converge to be adjacent to the loops of neighboring flap portions in the assembled inner tank. A cord or cable 36 is laced through the loops 34 in a weave pattern to draw the loops together and thereby draw the flap portions taut to provide structural rigidity to the baffle 28. The loop 34 together with the cable 26 that weaves through the loops 34 of adjacent flap portions provides an example of a link mechanism that cooperates with the terminal ends of the panels of each internal baffle to interconnect the terminal ends to provide a barrier to fluid flow across the internal baffle when the bladder is filled with fluid. However, other examples of a suitable link mechanism may be used.

The manufacture of prior art collapsible liquid transport tanks having internal baffles is an extremely labor intensive process, especially during the final stage when each tank has to be closed and the baffles have to be installed and/or assembled on the inside of the substantially closed shell. In contrast, in the flexible liquid transport tank of the present invention, all baffle components are preinstalled on the individual tank panels before the tank panels are assembled. This significantly reduces the labor component of manufacturing the collapsible liquid transport tanks of the present invention. After the tank panels are welded together (techniques for doing so are well known) to substantially closing the inner tank shell, a person climbs inside the inner tank via an encapsulated access hole (which is sealed in the finished product) and performs the final assembly of the baffles 28 by lacing the baffles flaps one by one—one cord/cable 36 per baffle 28. Advantageously, since the baffles 28 are composed from separate sections or flap portions 30 (which are joined together centrally by the cord/cable 36) it is possible to weld these sections on a flat panel prior to assembly of the panels, which is a relatively simple process. This is in contrast to having to weld single piece baffles with curvilinear contours onto a panel if the baffles were not composed out of separate sections.

After the panels of the inner tank have been assembled to define the shape of the inner tank 12, the baffle sections or flap portions 30 of each baffle 28 will be oriented in a plane with their base portions 32 being welded to the inside surface of the inner tank and their free end portions radiating inwardly towards the centre of the baffle. The terminal end of each baffle section or flap portion 30 is provided with a loop 34, which is produced by folding end of the fabric section to define the loop and then weld it onto itself. Hence, once the panels of the inner tank are assembled and the inner tank has taken shape, the loops 34 on the flap portions 30 of each baffle are proximate to the loops 34 of the other flap portions on the same baffle. A cable 36, which is conveniently produced from the same material as the inner tank by taking a long strip, folding it lengthwise, and welding it onto itself, is laced through each of the loops 34 on one baffle 28 in a weave pattern so that the flap sections are drawn taut to provide structural rigidity to the baffle 28. The ends of the cable 36 are provided with loops, and these are drawn together once the cable has been laced through the flap portions, and connected by quick connect chain link (not shown). This is repeated with each baffle 28. In this way, the inside of the inner tank only has components that are made from the same fabric as the inner tank, exception for the quick connector. The assembled baffles 28 define a number of voids 42 in between adjacent flap portions, and some ports 44 are provided in some (or all) of the flap portions to allow a reduced flow of liquid between sections of the inner tank during filling and emptying of the inner tank. In the illustrated embodiment, the transverse panels or flap portions 30 are shaped in manner that enables the internal transverse baffle 28 to cover most of the internal cross sectional area defined by the bladder with liquid therein such that adjacent internal transverse baffles 28 define a substantially compartmentalized space in between said adjacent transverse baffles.

With the inner tank 12 filled, the transverse baffles 28 provide a wave buffering system to counteract longitudinal acceleration of the fluid within the inner tank 12. The baffle outer contour coincides with the natural contour of the filled tank, and because the baffle is a structure comprised of separate flap portions that are bundled up by the cable, it significantly reduces the material weight and bulk of the tank. It also significantly reduces the material and labor costs of producing the baffle structures, resulting in a tank and baffle design that is efficient and effective in minimizing fluid dynamics within the tank. The baffles of the present invention maintain the natural width and length of the inner tank, and prevent the propagation of waves along the tank's length due to aircraft evolutions. As a result, they prevent the centre of gravity of the tank from shifting, which is very important for aircraft controllability.

The number of flap portions 30 per baffle may vary depending on the cross sectional dimensions of the desired inner tank, as well as by other factors such as the overall dimensions of the tank, the number and location of baffles, the baffle structure, the harnessing layout and the type of the aircraft.

Connection points 46 between the inner tank and the outer tank may be also provided. Structurally the connection point may be a pair of handles one of each installed on the outside of the inner tank and a corresponding one on the inside of the outer tank so that they are opposite each other. This is a quick connection which is can be easy connected or disconnected if needed. There may be three connection points on each end of the tanks, but the numbers may vary depending on dimensions of the tanks. The purpose of these points is to maintain proper inner tank position inside the outer tank and to prevent the inner tank from shifting during operation (when it's empty). Rounded corners 48 on both the inner tank and the outer tank are provided for smooth stress distribution.

Figure 9:
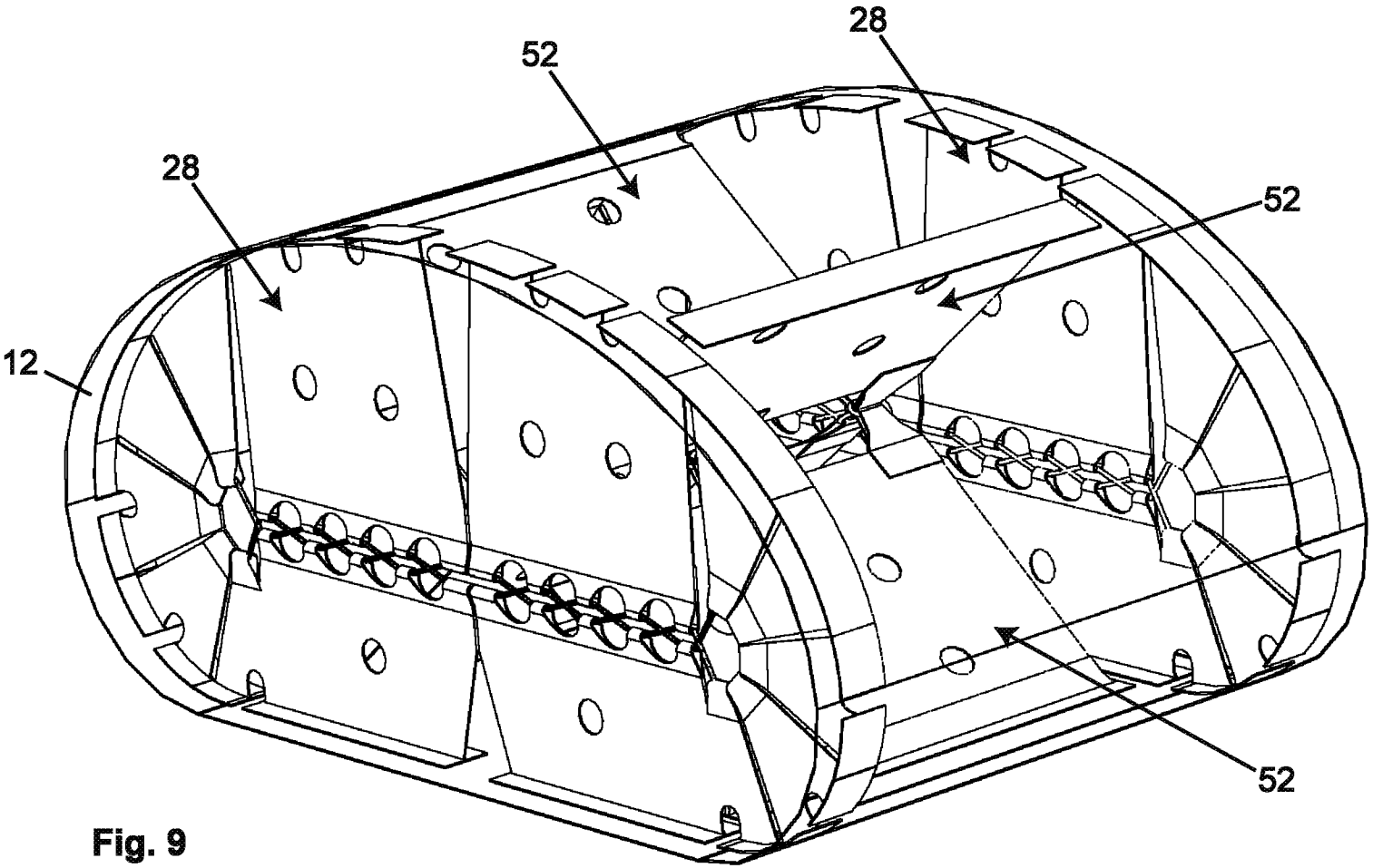
FIG. 9 is a perspective view of a section of another embodiment of an inner tank of the present invention shown with the walls of the inner tank shown translucent to reveal the structure of the baffles within the inner tank.
Figure 10:
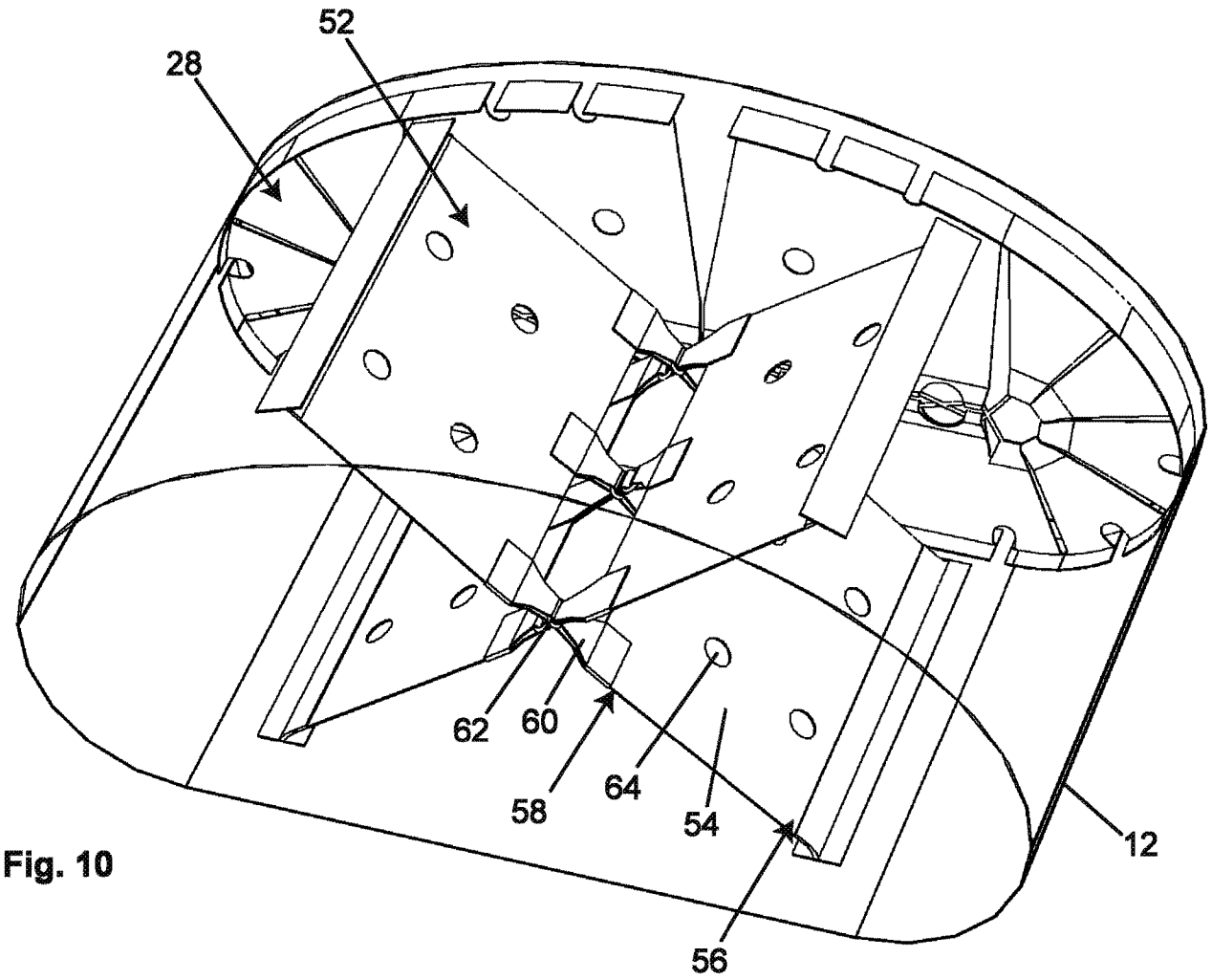
FIG. 10 is a perspective view of the section of the inner tank of FIG. 9 shown with the foremost baffle removed and with the walls of the inner tank shown translucent to reveal the structure of the baffles within the inner tank.

Referring to FIGS. 9 and 10, sections of another embodiment of the present invention is shown which, in addition to the transverse baffles 28, includes longitudinal baffles 52 that extend between two adjacent transverse baffles 28 to provide additional resistance to lateral fluid surges in the tank 10 for certain applications in which the tank 10 is likely to encounter lateral acceleration in addition to longitudinal acceleration. For example, helicopter applications where the aircraft creates side-to-side movement (lateral acceleration) for the tank contents in addition to front to back movement (longitudinal acceleration) results in both lateral and longitudinal fluid surges within the tank.

Each longitudinal baffle 52 comprises a plurality of longitudinally aligned panels 54 made of the same or similar flexible material as the baffles 28. Each longitudinal panel 54 includes a base portion 56 along a base edge of the panel 54 and a connecting portion 58 adjacent the terminal edge of the panel opposite of the base portion 56. The base portion 56 of each longitudinal panel is connected (for example welded) to the inside wall of the inner tank 12 in a manner such that each base portion 56 is parallel to the longitudinal axis of the inner tank 12 and spaced approximately equidistant from the adjacent base portions around the periphery of the inside wall of the inner tank 12. The connection portion 58 of each panel 54 is attached to the connecting portions of the other panels in a manner such that the connecting panels 54 form straight-line connection lines between opposite top and bottom sides of the inner tank shell 12 in a cross like manner. In some embodiments, the panels 54 of each longitudinal baffle 52 may radiate from near the longitudinal axis of the inner tank toward (and connect with) the wall of the inner tank 12. Accordingly, the longitudinal panels 54 of the longitudinal baffle 52 define longitudinal compartments between adjacent transverse baffles with restricted fluid flow between said longitudinal compartments when the bladder is filled with fluid.

In the illustrated embodiment, the connecting portion 58 comprises a plurality of extensions 60 that end in a D-ring 62. The D-rings of the panels are interconnected or linked with the adjacent D-rings of the other panels. However, other configurations of connecting portions, and mechanisms of interconnecting same, will be apparent to a skilled reader. Additionally, each panel includes a number of holes 64 to allow limited fluid flow through the panels to allow for gradual fluid movement and equalization of pressures across the panels. The number, placement and configuration of the holes may be varied as desired or as required for a particular application of the present invention.

Other aspects and features of the present invention will become apparent to those of ordinary skill in the art upon review of the following description of specific embodiments of the invention in conjunction with the accompanying figures.

While the above description and illustrations constitute preferred or alternate embodiments of the present invention, it will be appreciated that numerous variations may be made without departing from the scope of the invention. It is intended that the invention be construed as including all such modifications and alterations.

What is claimed is:

1. A flexible tank for transporting liquids on or in a vehicle comprising:

a flexible and collapsible bladder adapted to contain liquid therein and having ports for filling and emptying the bladder, the bladder defining a length and an interior perimeter;

a plurality of vertical flexible internal baffles within the bladder for dampening surges of liquid, wherein each internal baffle is aligned in a plane transverse to the length of the bladder and comprises a plurality of flexible panels, wherein each panel includes a base portion connected to the interior surface of the bladder and an unsupported portion with a terminal end opposite the base portion, wherein each panel is shaped so that its terminal end converges with the terminal end of one or more adjacent panels; and a link mechanism cooperating with the terminal ends of the panels within each internal baffle to interconnect the terminal ends and provide a barrier to fluid flow across the internal baffle when the bladder is filled with fluid.

2. The apparatus as claimed in claim 1, wherein the panels of each internal baffle are aligned along the plane transverse to the length of the bladder when the terminal ends are interconnected by the link mechanism.

3. The apparatus as claimed in claim 2, wherein the base portions of the panels in aggregate extend around the interior perimeter of the bladder.

4. The apparatus as claimed in claim 2, wherein the link mechanism comprises a loop portion provided in the terminal end of each panel and a cord that weaves through the loop portions to interconnect the terminal ends of the panels.

5. The apparatus as claimed in claim 1, wherein the link mechanism comprises a loop portion provided in the terminal end of each panel and a cord that weaves through the loop portions to interconnect the terminal ends of the panels.

6. The apparatus as claimed in claim 1, wherein each panel is further shaped in a manner that enables the internal baffle to cover most of the internal cross sectional area defined by the bladder with liquid therein such that adjacent internal transverse baffles define a substantially compartmentalized space in between said adjacent transverse baffles.

7. The apparatus as claimed in any one of claims 1 to 6, further including a liquid impermeable flexible outer bladder of an abrasion resistant material that is adapted to removably receive said flexible and collapsible bladder adapted to contain liquid therein, wherein the outer bladder includes an access port through which said flexible and collapsible bladder may be placed in and removed from the outer bladder, and a liquid impermeable zipper cooperating with the access port to provide a liquid tight seal of the access port.

8. The apparatus as claimed in claim 7 further including adjustable securing straps or webbing attached to the outer bladder and adapted to cooperate with securing points on the vehicle for securing the apparatus to the vehicle.

9. The apparatus as claimed in claim 7, further including a longitudinal baffle situated between two adjacent transverse baffles, the longitudinal baffle comprising:

a plurality of flexible planar longitudinal panels, each longitudinal panel having a second base portion connected to the inside surface of the bladder along a line parallel to the longitudinal axis of the bladder and spaced from the second base portions of adjacent longitudinal panels around the interior perimeter of the bladder, each longitudinal panel having a second unsupported portion with a second terminal edge opposite the second base portion and being adapted to converge with the second terminal edges of adjacent longitudinal panels along a line parallel to the longitudinal axis of the bladder in a manner that defines longitudinal compartments between adjacent transverse baffles with restricted fluid flow between said longitudinal compartments when the bladder is filled with fluid; and a second link mechanism that cooperates with the second terminal edges of adjacent longitudinal panels to interconnect the second terminal edges.

10. The apparatus as claimed in any one of claims 1 to 6, further including a longitudinal baffle situated between two adjacent transverse baffles, the longitudinal baffle comprising:

a plurality of flexible planar longitudinal panels, each longitudinal panel having a second base portion connected to the inside surface of the bladder along a line parallel to the longitudinal axis of the bladder and spaced from the second base portions of adjacent longitudinal panels around the interior perimeter of the bladder, each longitudinal panel having a second unsupported portion with a second terminal edge opposite the second base portion and being adapted to converge with the second terminal edges of adjacent longitudinal panels along a line parallel to the longitudinal axis of the bladder in a manner that defines longitudinal compartments between adjacent transverse baffles with restricted fluid flow between said longitudinal compartments when the bladder is filled with fluid; and a second link mechanism that cooperates with the second terminal edges of adjacent longitudinal panels to interconnect the second terminal edges.

* * * * *